United States Patent [19]

Taylor

[11] 4,106,933

[45] Aug. 15, 1978

[54] PIEZOELECTRIC METHOD AND MEDIUM FOR PRODUCING ELECTROSTATIC CHARGE PATTERNS

[75] Inventor: Allen L. Taylor, Woodbury, Minn.

[73] Assignee: Minnesota Mining and Manufacturing Company, Saint Paul, Minn.

[21] Appl. No.: 587,904

[22] Filed: Jun. 18, 1975

[51] Int. Cl.[2] ..... G03G 15/02; G03G 13/02

[52] U.S. Cl. ..... 96/1.5 R; 310/363; 96/1 C; 96/1.2; 96/1 R; 310/311; 427/100

[58] Field of Search ..... 315/55; 310/8, 363; 96/1.5, 1 C, 1 SD, 1 R; 427/100

[56] References Cited

U.S. PATENT DOCUMENTS

| | | | |
|---|---|---|---|
| 2,633,543 | 3/1953 | Howatt | 310/363 |
| 2,739,243 | 3/1956 | Sheldon | 310/363 |
| 3,202,824 | 8/1965 | Yando | 310/8 |
| 3,677,751 | 7/1972 | Ohta | 96/1 R |
| 3,713,822 | 1/1973 | Kiess | 96/1.5 |
| 3,719,481 | 3/1973 | Makino | 96/1 R |
| 3,775,104 | 11/1973 | Matsumoto | 96/1 R |
| 3,931,446 | 1/1976 | Murayama et al. | 427/100 |

OTHER PUBLICATIONS

Journal of Audio Engineering Society, 1975, p. 72.
Xerography Dassauer & Clark, pp. 230 & 268.

*Primary Examiner*—Roland E. Martin, Jr.
*Assistant Examiner*—John L. Goodrow
*Attorney, Agent, or Firm*—Cruzan Alexander; Donald M. Sell; Walter N. Kirn

[57] ABSTRACT

A radiation sensitive piezoelectric copy method and medium for producing positive or negative latent electrostatic charge patterns. In a first embodiment the copy medium includes a poled, radiation transmissive piezoelectric insulative layer, an electrically conductive layer less compliant than the piezoelectric layer, and a photoconductive layer interposed between and electrically connected with the piezoelectric and electrically conductive layers. A second embodiment is similar to the first embodiment except it does not contain an electrically conductive layer. A third embodiment is similar to the second embodiment except that an electrically conductive layer is juxtaposed with and electrically connected to the piezoelectric layer. Fourth and fifth embodiments are similar to the first embodiment except that the fourth embodiment includes a second layer of poled, piezoelectric material interposed between the photoconductive and electrically conductive layers, and the fifth embodiment includes a plurality of photoconductive layers, each being sensitive to a single, but different, color of light. While the process can be accomplished in various permutations, the basic process involves forming an electrostatic charge on the poled piezoelectric layer by stressing the piezoelectric layer, transferring at least a portion of the charge such that there is both charge and voltage across the photoconductive layer, and selectively exposing the photoconductive layer to appropriate radiation.

49 Claims, 33 Drawing Figures

PIEZOELECTRIC METHOD AND MEDIUM FOR PRODUCING ELECTROSTATIC CHARGE PATTERNS

BACKGROUND OF THE INVENTION

1. Field of the Invention

The present invention relates in general to electrostatic copy mediums and a method for producing positive and negative latent electrostatic charge patterns. More specifically it relates to copy mediums and a method for producing latent electrostatic charge patterns utilizing piezoelectric and photoconductive materials.

2. Description of the Prior Art

A number of patents disclose processes for producing charge patterns utilizing multi-layer copy mediums having an insulative layer, an electrically conductive layer and a photoconductive intermediate layer. Such disclosures are taught in U.S. Pats. to Ohta et al, No. 3,677,711, Makino et al, No. 3,719,481 and Matsumoto, No. 3,775,104. These patents teach initial charging of copy mediums by applications of ions from external corona discharge power sources, and also teach the usage of such power sources for applying ions to copy mediums during image formation.

Another known copy medium and process is disclosed in U.S. Pat. No. 3,713,822 issued to Kiess. The medium consists of a layer of crystalline photoconductive-pyroelectric compound on an electrically conductive layer. To produce a copy by use of such a medium in accordance with the teachings of the Kiess patent, first the photoconductive-pyroelectric compound is heated in the dark to develop an initial positive electrostatic charge on one surface of the compound and an initial negative electrostatic charge on the opposite surface. Then, the charged compound is exposed to a light image which converts the exposed image areas from a low conductivity to a high conductivity. The negative and positive charges in the exposed areas combine thus reducing surface charge and voltage potential in the exposed areas. The result is an electrostatic charge pattern on the exposed surface of the photoconductive-pyroelectric compound. However, since the electrostatic charge pattern representative of the image is formed on the photoconductive-pyroelectric layer, it must be immediately developed to avoid dispersion of charge as the result of leakage through the photoconductive-pyroelectric layer.

My co-pending U.S. application Ser. No. 385,849 filed Aug. 6, 1973 now U.S. Pat. No. 3,992,204 and entitled "Method and Medium for Producing Electrostatic Charge Patterns" discloses a multilayer copy medium having a pyroelectric insulative layer, an electrically conductive layer and an intermediate photoconductive layer. A process is also taught in such application for producing a latent electrostatic charge pattern by use of the disclosed medium, which process is performed by first subjecting the pyroelectric layer to a temperature change to develop an initial positive electrostatic charge on one surface of the pyroelectric layer and an initial negative electrostatic charge on the opposite surface of the pyroelectric layer. Then, at least a portion of the charge from the surface of the pyroelectric layer not in contact with the photoconductive layer is transferred to the electrically conductive layer such that there are opposite polarity charges and a voltage potential across the photoconductive layer. Last, exposure of the photoconductive layer to a light image converts the exposed image areas of the photoconductive layer from a low conductivity to a high conductivity, thus, permitting the negative and positive charges of the exposed areas to combine.

Further disclosed in my above described co-pending application is an improved method and medium for producing an image on the surface of an insulative layer by means of an image transfer from the surface of the photoconductor to the insulative layer.

The present invention differs from the known copy mediums described above by employing a piezoelectric layer to provide an insulative layer that can readily be charged by stressing without the need for external charging units.

SUMMARY OF THE INVENTION

An improved medium and process for developing a latent electrostatic charge pattern are provided by the present invention. In the first three preferred embodiments the improved medium includes a layer of poled piezoelectric insulative material having a broad surface juxtaposed with and electrically connected to the broad surface of a layer of photoconductive material. Preferably, the piezoelectric material is uniformly poled so that equal magnitude and opposite polarity charges are developed on the upper and lower surfaces of the piezoelectric layer when it is subjected to stress. Such stress may be accomplished by simple mechanical means such as bending, stretching or compressing the piezoelectric layer. Thus, an expensive external charging mechanism such as a corona discharge is not required for initially charging the medium. A fourth preferred embodiment is comprised of two layers of piezoelectric material juxtaposed with and electrically connected to a layer of photoconductive material. Such embodiment produces faster imaging and more resolution than that of the first three embodiments. Each of the preferred embodiments may be modified to include a photoconductive layer composed of suitable material for making either one color or multiple color copies.

The process of the present invention involves stressing the piezoelectric insulative layer to establish charges on its upper and lower surfaces and then transferring a portion of these charges such that charges are present on the upper and lower surfaces of the photoconductive layer and a voltage potential exists across the photoconductive layer. The photoconductive layer is then imaged by selectively exposing it to radiation so that charges move across the photoconductive layer producing a decrease in voltage potential in the exposed areas and the formation of a latent image on the exposed surface of the copy medium. Additional steps may be performed to reverse the image. A number of variations of this process may also be employed.

DESCRIPTION OF THE PREFERRED EMBODIMENTS

Figure 1:
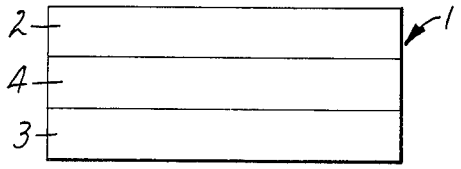
FIG. 1 is a diagrammatic view of a first embodiment of the present invention.

FIG. 1 shows a copy medium 1 that represents a first preferred embodiment of the present invention. The copy medium 1 includes a poled piezoelectric layer 2, an electrically conductive layer 3, and an intermediate photoconductive layer 4 juxtaposed with and electrically connected to the piezoelectric layer 2 and electrically conductive layer 3. Either the piezoelectric layer 2 or the electrically conductive layer 3 is light transmissive and the electrically conductive layer 3 is preferably less compliant than the layer 2 for a purpose to be described below.

The piezoelectric layer 2 may be formed from a thin sheet of polyvinylidene fluoride or a ceramic plate of lanthanum-modified lead zirconate-titanate, with the dipoles of the layer 2 poled to be oriented in an aligned relationship. Although a few piezoelectric materials have dipoles that are naturally aligned in a poled relationship, normally dipoles of piezoelectric materials are essentially arranged in random fashion. These dipoles can be rearranged in orientation when a piezoelectric material is heated above a particular temperature known as the poling temperature. When a piezoelectric material is heated above its poling temperature and an electric field is applied, the dipoles orient themselves in accordance with the field. The degree of dipole orientation is a function of the piezoelectric material's temperature, the applied field strength and the length of time the field is applied. For example, in polyvinylidene fluoride substantial poling begins when the film is heated to a temperature greater than 90° C and an electric field of at least about 4,000 volts per millimeter of thickness is applied for approximately 15 minutes when the material is above this temperature. Increasing the temperature and/or the applied field will increase the poling until saturation is reached.

When the poled film is cooled below the poling temperature the field may be removed and the dipoles will remain as oriented by the applied field. Once poled, a piezoelectric material will thereafter produce opposite charges on its surface when it is stressed. Care should be taken though to insure that the material is not heated above its poling temperature for extended periods in order that the dipoles are not permitted to return to a random orientation.

The photoconductive layer 4 may be uniformly coated on the piezoelectric layer 2 in a conventional manner such as by being vaporized or sublimed onto the surface of the layer 2. A preferred coating comprises dispersing powdered photoconductor in a binder-solvent system and coating this mixture on the layer 2 using knife coating or similar techniques. Examples of binders that may be utilized in such a coating are: Pliolite S-7, a copolymer of styrene and butadiene; VYHH, a copolymer of vinyl chloride and vinyl acetate; and Gelva V-100, polyvinyl acetate.

The photoconductive layer can be an inorganic compound, e.g. CdS, CdSe, $CdS_{1-x}Se_x$, $TiO_2$, $AS_2S_3$, $As_2S_{3-y}Se_y$, GaP, ZnO, ZnS, ZnTe, PbS, PbSe, InAs, $Hg_{1-x}Cd_xTe$, where $x$ is from 0 to 1, and $y$ is from 0 to 3. Organic photoconductors such as polyvinylcarbazole can also be used. Selection of the photoconductor is dependent upon the radiation to be utilized in imaging and such radiation may be visible light, X-rays, gamma rays, infrared rays, or ultraviolet rays. Tabulated below are some of the photoconductors that can be used with various types of radiation.

| Radiation | Photoconductors |
|---|---|
| Infrared | $Hg_{1-x}Cd_xTe$; PbS; PbSe; InAs where x = 0 to 1 |
| Visible | CdSe; GaP; ZnTe; CdS; ZnO; $TiO_2$; $As_2S_3$; |
| Ultraviolet | ZnS; ZnO |
| X-rays or γ-rays | Any of the above (may be doped with metal compound to improve absorption, for example heavy metals). |

The conductive layer 3 can be formed from a thin metal coating applied by such methods as spraying, sputtering, or conductive adhesive bonding. The radiation transmission characteristics of the conductive layer may be poor if the piezoelectric layer 2 is radiation transmissive. Otherwise the layer 4 must be radiation transmissive because it is essential that one of the layers 2 or 4 be transmissive to radiation.

Figure 2:
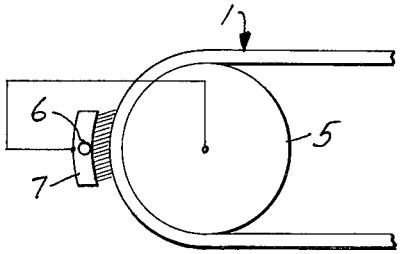
FIG. 2 is a diagrammatic view of a process for charging the copy medium shown in FIG. 1.
Figures 3A, 3B:
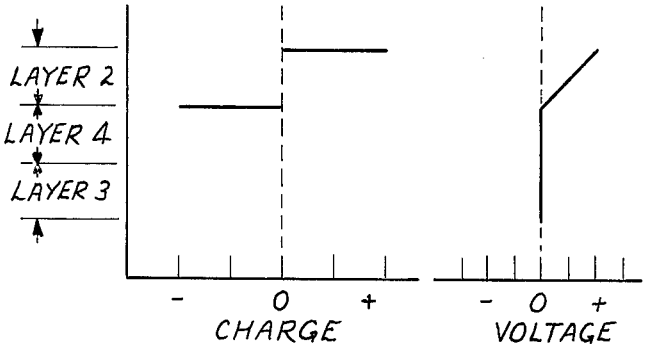
FIGS. 3*a* and 3*b* are respectively graphical representations of the charge and voltage of the copy medium of FIG. 1 after a first step of the method of the present invention is performed.

FIG. 2 shows a preferred method of stressing the piezoelectric layer 2 by beinding the copy medium 1 around an electrically conductive cylinder 5. When the piezoelectric layer 2 is bent the entire piezoelectric layer 2 will be stretched to provide approximately equal magnitude and opposite polarity charges on the upper and lower surfaces of the layer 2. While the layer 2 is in a stressed (bent) state it is electrically discharged by means of a flood light 6 and a Pluton® brush 7. The light floods a portion of the layer 2 while the brush 7 electrically contacts the same portion of the layer 2. Because the layer 2 is light transmissive, as previously described, flooding the layer 2 with light causes the resistance of the layer 4 to substantially decrease. The Pluton® brush 7 is electrically connected to the cylinder 5 so that an electrical short circuit is established between the upper and lower surfaces of the portion of the layer 2 flooded with light to remove substantially all charges and potential from the layer 2. Thus, when the layer 2 is returned to its ambient unstressed state, charges of polarity opposite to those previously produced by the initial bending are developed on the upper and lower surfaces of layer 2 and a voltage potential opposite to that previously produced also results. FIG. 3 is a graphic illustration of the charge distribution and voltage potential of the layers 2, 3 and 4 after charging of the layer 2 is complete. For simplicity, it has been assumed the electrically conductive layer 3 is at zero potential throughout.

The initial charging of the upper and lower surfaces of the piezoelectric layer 2 by stressing that layer could be accomplished in other ways. The stressing could be accomplished by stretching or compressing the layer 2 rather than by bending it. The stress, discharge, unstress cycle could be replaced by a simple stress cycle; however, the layer 2 would then have to be maintained in a stressed state.

Figures 4A, 4B:
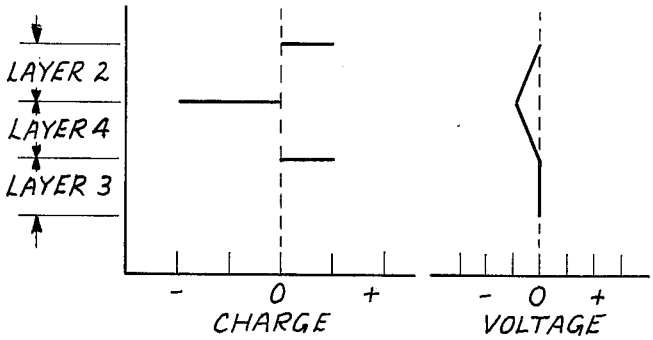
FIGS. 4*a* and 4*b* are respectively graphical representations of the charge and voltage of the copy medium of FIG. 1 after a second step of the method of the present invention is performed.

After charging of the piezoelectric layer 2, the next step in the process of the present invention is to neutralize the upper surface of the piezoelectric layer 2 in the absence of radiation by means of a Pluton® brush or other such device for forming an electrical contact between the entire upper surface of the layer 2 and the electrically conductive layer 3. During neutralization, a portion of the charge on the upper surface of the piezoelectric layer 2 is transferred to the lower surface of the photoconductive layer 4 because charges automatically flow from a higher energy state to a lower energy state. If the layers 2 and 4 are of equal capacitance, one half of the charges initially on the upper surface of the layer 2 will be transferred to the lower surface of the layer 4 as illustrated in the graphs of charge and voltage potential in FIG. 4.

Figures 5A, 5B, 5C, 5D:
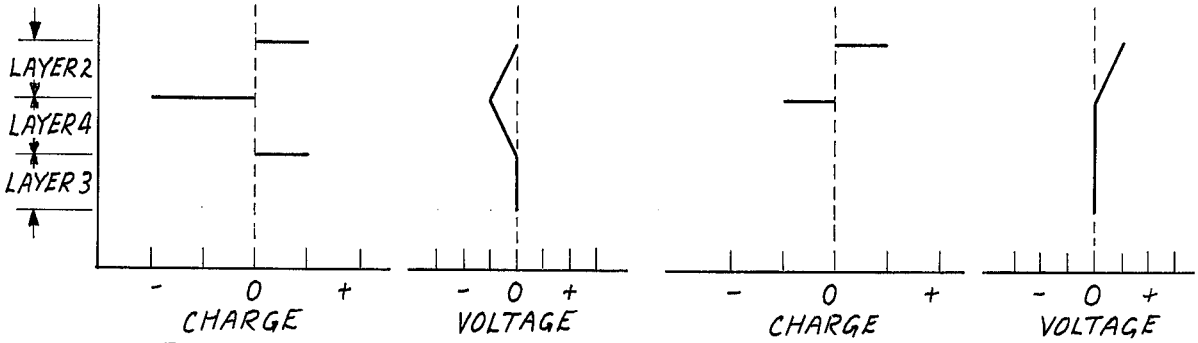
FIGS. 5a–5d are graphical representations of the charge and voltage of the copy medium of FIG. 1 after a third step of the method of the present invention is performed with FIGS. 5a and 5b respectively representing the charge and voltage in the nonexposed areas and FIGS. 5c and 5d respectively representing the charge and voltage in the exposed areas.

After the upper surface of the piezoelectric layer 2 is neutralized, the connection between it and the conductive layer 3 is removed and the piezoelectric layer 2 is selectively exposed to radiation, such as a light image. Selective exposure of the layer 2 also exposes certain areas of the layer 4 and increases the conductivity of the exposed areas of the layer 4. The positive charges on the lower surface of the photoconductive layer 4 registered with the exposed areas of that layer effectively flow through that layer and combine with corresponding charges on the lower surface of the piezoelectric layer 2. FIGS. 5*a* and 5*b* graphically illustrate the resulting charge and voltage potentials of the layers 2 and 4 in the nonexposed areas. FIGS. 5*c* and 5*d* graphically illustrate the resulting charge and voltage potentials of the exposed areas of the layers 2 and 4. FIGS. 5*b* and 5*d* illustrate that the voltage potential between the nonexposed and exposed areas of the upper surface of the layer 2 is equal to one-half the original charging voltage of the layer 2. This result is due to the magnitude of charge transfer that occurred during neutralization, with the magnitude of charge transfer during neutralization being determined by the relative capacitance of the layers 2 and 4. Such potential difference between the exposed and nonexposed areas of the piezoelectric layer 2 produces an electrostatic latent charge pattern of the radiation image that can be developed by the use of conventional toner powder techniques.

The latent electrostatic charge pattern on the upper surface of the piezoelectric layer 2 may be reversed by the additional steps of again neutralizing the upper surface of the piezoelectric layer 2 and then flooding the entire photoconductive layer 4 with radiation.

Figure 6A:
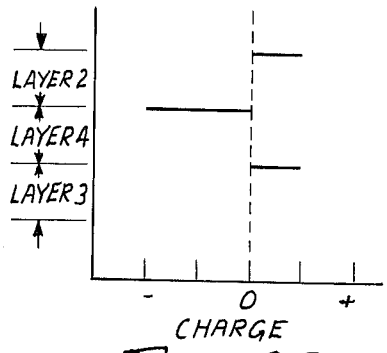
FIGS. 6a–6d are graphical representations of the charge and voltage of the copy medium of FIG. 1 after an optional fourth step of the present invention is performed, (neutralizing) with FIGS. 6a and 6b respectively representing the charge and voltage in the nonexposed areas and FIGS. 6c and 6d respectively representing the charge and voltage in the exposed areas.
Figure 6B:
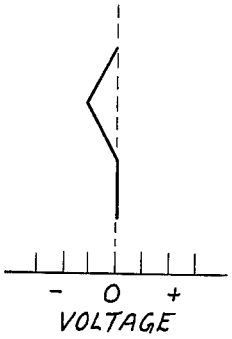
Figure 6C:
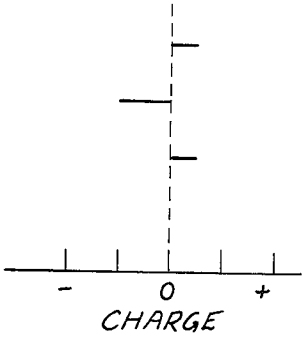
Figure 6D:
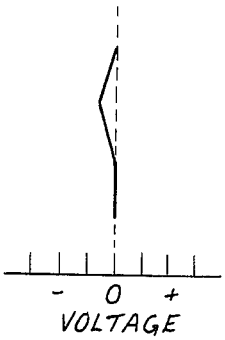
Figure 7A:
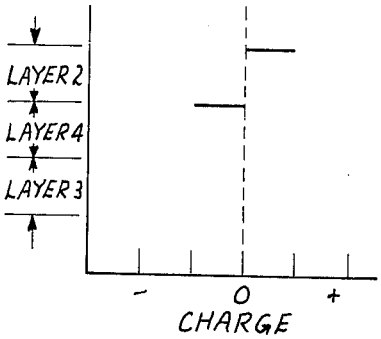
FIGS. 7a–7d are graphical representations of the charge and voltage of the copy medium of FIG. 1 after an optional fifth step of the present invention is performed, (flooding) with FIGS. 7a and 7b respectively representing the charge and voltage in the nonexposed areas and FIGS. 7c and 7d respectively representing the charge and voltage in the exposed areas.
Figure 7B:
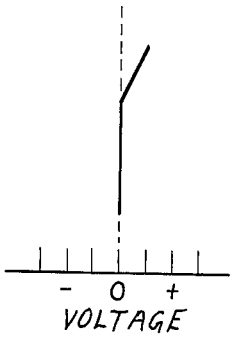
Figure 7C:
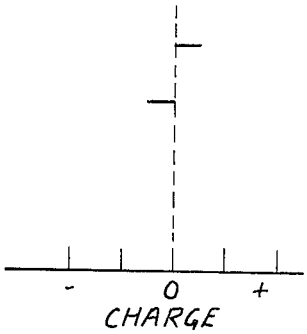
Figure 7D:
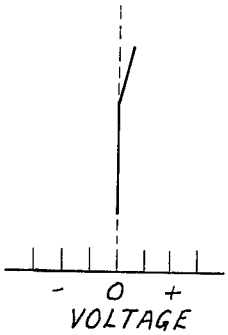

As previously described, neutralization of the upper surface of the piezoelectric layer 2 is accomplished by connecting that surface to the electrically conductive layer 3. FIGS. 6*a* and 6*b* graphically illustrate the charge and voltage in the nonexposed areas after neutralization. Because the charge and voltage in these areas have not changed since the first neutralization step, they are not affected by the second neutralization. In contrast to such unaffected areas, FIGS. 6*c* and 6*d* graphically illustrate the charge and voltage in the exposed areas after the second neutralization. FIG. 6*c* illustrates the charge which has again been transferred from the upper surface of the piezoelectric layer 2 to the lower surface of the photoconductive layer 4 in accordance with the relative capacitance of the two layers. FIGS. 6*b* and 6*d* illustrate that both the nonexposed and exposed areas of piezoelectric layer 2 are at zero potential with respect to the conductive layer 3, while the corresponding areas on the lower surface of piezoelectric layer 2 have a high negative voltage and a low negative voltage with respect to the conductive layer 3.

Subsequent to the second neutralization of the layer 2, flooding of the entire photoconductive layer 4 is performed. Such flooding effectively connects the lower surface of piezoelectric layer 2 to the electrically conductive layer 3 while not disturbing the existing voltage potentials between the upper and lower surfaces of piezoelectric layer 2. FIGS. 7*a*–7*d* illustrate the charge and voltage potentials that exist after flooding. As can be seen, the potentials on the upper surface of the piezoelectric layer 2 with reference to the conductive layer 3 in the nonexposed areas have a high positive potential while those in the exposed areas have a lower positive potential. Thus, the image on the upper surface of the layer 2 has been reversed. An advantage of image reversal is that the final flooding step removes all charge and voltage from the photoconductive layer 4 so that the latent charge image only exists on the surfaces of the piezoelectric insulative layer 2 and thus can no longer be affected by either leakage across or accidental exposure of the photoconductive layer 4. Accordingly, the latent electrostatic charge pattern on the upper surface of the piezoelectric layer 2 may be developed by the use of conventional toner powder techniques in either the light or the dark.

Figure 8A:
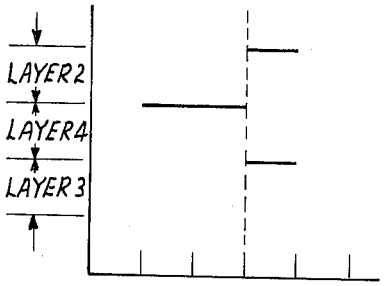
FIGS. 8a–8d are graphical representations of the charge and voltage of the copy medium of FIG. 1 when the neutralizing and imaging are performed substantially simultaneously with FIGS. 8a and 8b respectively representing the charge and voltage in the nonexposed areas and FIGS. 8c and 8d respectively representing the charge and voltage in the exposed areas.
Figure 8B:
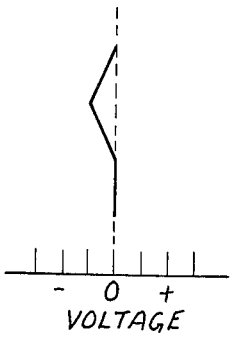
Figure 8C:
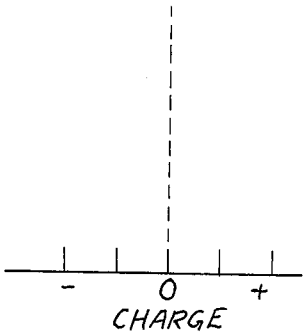
Figure 8D:
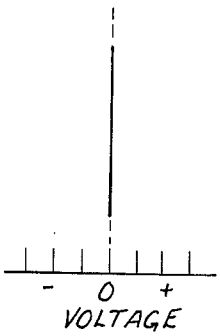
Figure 9A:
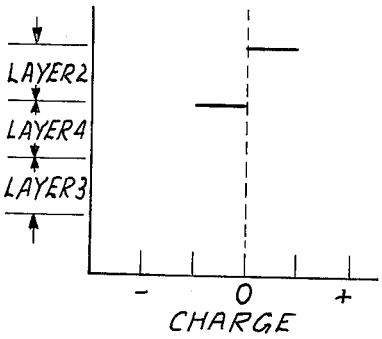
FIGS. 9a–9d are graphical representations of the charge and voltage of the copy medium of FIG. 1 after flooding if neutralizing and imaging have been performed substantially simultaneously with FIGS. 9a and 9b respectively representing the charge and voltage in the nonexposed areas and FIGS. 9c and 9d respectively representing the charge and voltage in the exposed areas.
Figure 9B:
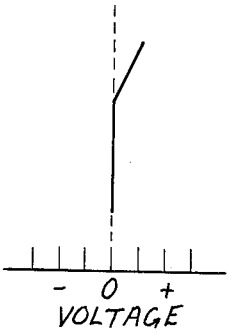
Figure 9C:
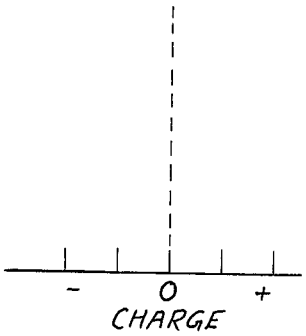
Figure 9D:
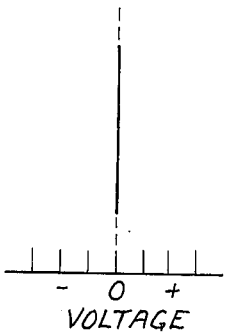

An image can also be produced by charging the piezoelectric layer 2, neutralizing the upper surface of the layer 2 and imaging the medium 1 substantially simultaneously, and then flooding the photoconductive layer 4. Charging of the layer 2 can be accomplished as previously described above. FIGS. 8*a* and 8*b*, and FIGS. 8*c* and 8*d* graphically illustrate the charge and voltage patterns of the nonexposed and exposed areas of the layers 2, 3 and 4 respectively after substantially simultaneous neutralizing and imaging is performed. FIGS. 8*c* and 8*d* illustrate that there is substantially no charge or voltage in the exposed areas of the medium 1, but charge and voltage does exist on the nonexposed areas of the lower surface of the layer 2 to form a latent image thereon. Flooding the entire photoconductive layer 4 brings the image to the upper surface of the piezoelectric layer 2 with the resulting charge and voltage patterns in the nonexposed and exposed areas as illustrated in FIGS. 9*a* and 9*b*, and FIGS. 9*c* and 9*d* respectively.

Thus the copy medium 1 provides a ready and convenient means for producing latent electrostatic charge patterns and the use of the piezoelectric layer 2 provides a great deal of flexibility in producing such charge patterns. Uniformly changing the stress on the piezoelectric layer 2 is equivalent to uniformly adding (or subtracting) charges and voltage to the piezoelectric layer 2 without disturbing the charge and voltage patterns that previously existed thereon. Moreover, by uniformly changing the stress on the piezoelectric layer 2, a number of additional advantages may be achieved, to wit:

(a) the magnitude of the charge and voltage potentials in the nonexposed and exposed areas can be increased or decreased (without changing the magnitude differential between the nonexposed and exposed areas).

(b) the magnitudes of the charge and voltage potentials in the nonexposed and exposed areas can be increased or decreased (without changing the magnitude differential between the nonexposed and exposed areas) such that the nonexposed and exposed areas are made opposite polarities.

(c) the magnitudes of the charges and voltage potentials in the nonexposed and exposed areas can be increased or decreased (without changing the magnitude differential between the nonexposed and exposed areas) such that the polarity in both the nonexposed and exposed areas is reversed which results in an image reversal.

Uniformly changing the stress on the piezoelectric layer could also be done between the various steps of the processes previously described. In addition, if the piezoelectric layer 2 also has pyroelectric properties, then the charge and voltage on the surfaces of the piezoelectric layer 2 could be uniformly changed by varying the temperature of the piezoelectric layer.

Figure 10:
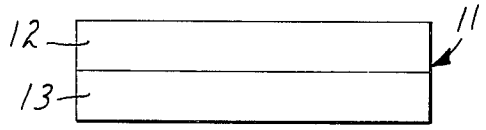
FIG. 10 is a diagrammatic view of a second embodiment of the present invention.

The use of the conductive layer 3 is not essential to the present invention as illustrated by a copy medium 11 of FIG. 10 that represents a second preferred embodiment of the present invention. The copy medium 11 is comprised of a poled piezoelectric layer 12 and a photoconductive layer 13. The lower surface of piezoelectric layer 12 is juxtaposed with and electrically connected to the upper surface of the photoconductive layer 13. The processes of forming a latent electrostatic charge pattern utilizing the copy medium 11 are similar to the processes utilized with the copy medium 1 except that a Pluton® brush or other such device must be used for electrically contacting the lower surface of the photoconductive layer 13. Thus, neutralization can be accomplished by running Pluton® brushes electrically connected together over the upper surface of piezoelectric layer 12 and the lower surface of photoconductive layer 13. Likewise, a conductive brush can be utilized to reference one surface of the copy medium 11 while developing the other surface with conventional toner powder techniques.

The preferred method of stressing the piezoelectric layer 12 is by stretching the medium 11 in the plane of its planar surfaces. Alternate means of charging the piezoelectric layer 12 include bending or compressing of the medium 11. When bending is used, it is preferred that the surfaces of the piezoelectric layer 12 be uniformly stretched (or compressed) to get uniform initial charge and voltage on that layer. If the medium 11 is not bent around a less compliant external device such as cylinder 5 in FIG. 1, then the layer 13 should be less compliant than the layer 12 to provide an axis of bending external to the layer 12.

Because the copy medium 11 includes no conductive layer, an image can be developed by conventional toner powder techniques on either the upper surface of the piezoelectric layer 12 or the lower surface of the photoconductive layer 13.

Figure 11:
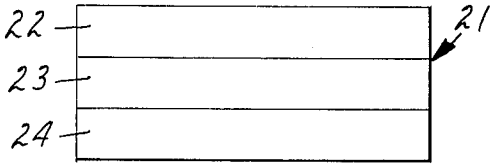
FIG. 11 is a diagrammatic view of a third embodiment of the present invention.

FIG. 11 shows a copy medium 21 that represents a third preferred embodiment of the present invention. The copy medium 21 is comprised of a photoconductive layer 22, a poled piezoelectric layer 23 and an electrically conductive layer 24. The lower surface of the photoconductive layer 22 is juxtaposed with and electrically connected to the upper surface of piezoelectric layer 23. The lower surface of piezoelectric layer 23 is juxtaposed with and electrically connected to the upper surface of the conductive layer 24.

The processes for utilizing the copy medium 21, are similar to the processes for utilizing the copy medium 1. Initial charging of the piezoelectric layer 23 is accomplished as described above and neutralization is accomplished by connecting the upper surface of the photoconductive layer 22 to the electrically conductive layer 24. The latent electrostatic charge patterns formed on the upper surface of the photoconductive layer 22 after selective exposure of the medium 21 are similar to those obtained on the upper surface of the piezoelectric layer 2 of the medium 1 and can be developed by conventional toner powder techniques.

Figure 12:
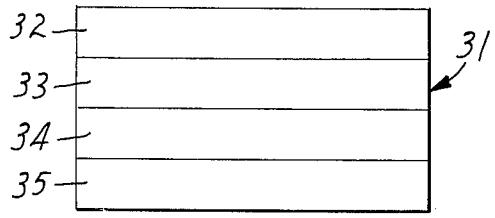
FIG. 12 is a diagrammatic view of a fourth embodiment of the present invention.

FIG. 12 shows a copy medium 31 that represents a fourth preferred embodiment of the present invention. The copy medium 31 is comprised of a first poled piezoelectric layer 32, a photoconductive layer 33, a second poled piezoelectric layer 34 and an electrically conductive layer 35. Each layer is in surface-to-surface contact with its adjacent layers. The processes previously described for the copy medium 1 are equally applicable for the copy medium 31. The piezoelectric layers 32 and 34 should be initially charged such that their respective upper surfaces have the same polarity charge and their respective lower surfaces have the same polarity charge with the upper and lower surfaces of each layer having opposite polarities of charge. If the piezoelectric layers 32 and 34 are arranged with their dipole orientations in the same direction, they can be charged by applying the same type of stress to each. If the dipole orientation are in opposite directions, they can be charged by applying complimentary stresses. For example, complimentary stresses can be generated by making the photoconductive layer 33 the least compliant layer in the medium 31 such that one piezoelectric layer would be stretched and the other compressed upon bending of the medium 31.

Two advantages of using the medium 31 instead of the medium 1 are that the double piezoelectric layer configuration furnishes faster imaging and more distinct resolution than that provided by the medium 1 for the same amount of stress.

Figure 13:
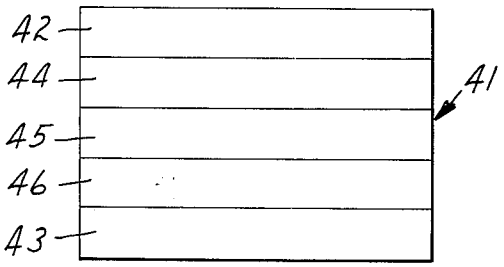
FIG. 13 is a diagrammatic view of a fifth embodiment of the present invention.

FIG. 13 shows a copy medium 41 that represents a fifth preferred embodiment of the present invention. The copy medium 41 is adapted to provide full color copies and includes an upper poled piezoelectric layer 42, similar to the layer 2, a lower conductive layer 43, similar to the layer 3 and three light transmissive photoconductive layers 44, 45 and 46 stacked between the layers 42 and 43. Each of the photoconductive layers 44, 45 and 46 are sensitive to a different one of the three primary color components of a color group. For example, in the arrangement that will be described herein, the layers 44, 45 and 46 are sensitive to only the colors red, yellow and blue respectively. The use of three separate photoconductive layers is not essential to this embodiment and instead, a single layer could be employed containing interspersed groups of color sensitive areas, each group including at least one such area for each primary color.

To provide a color producing copy image with the medium 41, the same initial method steps of charging the poled piezoelectric layer 42 and then neutralizing and imaging are employed, as previously described for the first embodiment. The only difference is that a color image must be used in the imaging step. During such imaging, the areas of the layers 44, 45 and 46 are exposed to the color image and respond to the particular colors present in the image to which they are sensitized, thereby describing the capacitance across the layers 44, 45 and 46 in those exposed areas. The decrease in capacitance in the exposed areas increases the voltage potential on the upper surface of the layer 42 in those areas. If the upper surface of the layer 42 is neutralized during imaging the voltage variation thereon is removed so that there is no image pattern yet developed. However, subsequent sequential flooding of the medium 41 with each particular color for layers 44, 45 and 46 will produce an increase of potential of the upper surface of the layer 42 at the prior nonexposed areas, but the potential of the prior exposed areas is not changed. Accordingly, to establish the color image, the medium 41 is flooded with red, yellow and blue light, one color at a time. Immediately following the flooding of the medium 41 with a particular colored light, the upper surface of the layer 42 is powdered with a complimentary colored toner powder. The toner powder is then transferred to a copy surface and the upper surface of the layer 42 is again neutralized before flooding by the next color. In this way, a color copy image is formed on the copy surface. Similarly, each of the copy mediums 11, 21 and 31 can be modified to include a plurality of color sensitive photoconductive layers to produce full color copies.

Figure 14:
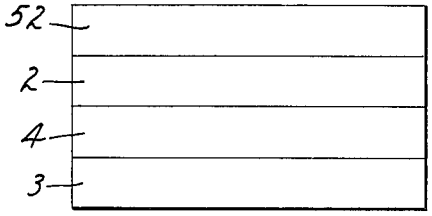
FIG. 14 is a diagrammatic view of a sixth embodiment of the present invention.
Figure 15:
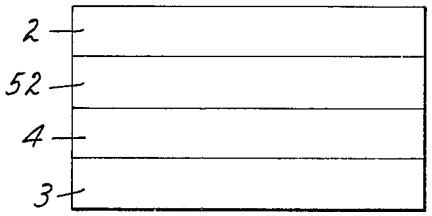
FIG. 15 is a diagrammatic view of a seventh embodiment of the present invention.
Figure 16:
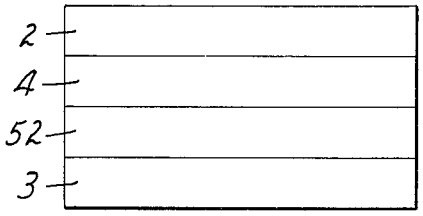
FIG. 16 is a diagrammatic view of an eighth embodiment of the present invention.

Any of the above embodiments could have an additional insulative layer (or layers) included between the various layers of the copy mediums and still be within the scope of the invention. Such an additional insulative layer 52 is illustrated in FIGS. 14, 15 and 16 as having been added to the copy medium of FIG. 1. Such insulative layer could be less compliant than a piezoelectric layer to provide an axis of bending external to such a piezoelectric layer.

What is claimed is:

1. A process for producing a latent electrostatic charge pattern on a surface of a copy medium that includes a layer of poled piezoelectric material with upper and lower surfaces and a layer of photoconductive material with upper and lower surfaces, with the lower surface of said piezoelectric layer juxtaposed with and electrically connected to the upper surface of said photoconductive layer, which process comprises the steps of:

(1) forming an electrostatic charge of one polarity on the upper surface of said piezoelectric layer and an electrostatic charge of opposite polarity on the lower surface of said piezolectric layer by mechanically stressing said piezoelectric layer;

(2) transferring a portion of the charge on the upper surface of said piezoelectric layer to the lower surface of said photoconductive layer; and (3) selectively exposing said photoconductive layer to radiation to develop an electrostatic charge pattern representative of the selective exposure on one of the surfaces of the copy medium.

2. The process recited in claim 1 wherein said charge is formed on said piezoelectric layer by the method of:

(1) stressing said poled piezoelectric layer to electrically charge said layer;

(2) discharging said poled piezoelectric layer; and (3) relaxing the stress on said poled piezoelectric layer.

3. The process recited in claim 2 wherein said poled piezoelectric layer is discharged by momentarily electrically shorting its surfaces together.

4. The process recited in claim 2 wherein said poled piezoelectric layer is discharged by momentarily electrically connecting the upper surface of said poled piezoelectric layer to the lower surface of said photoconductive layer while said medium is flooded with radiation.

5. The process recited in claim 1 wherein said photoconductive layer of said copy medium is comprised of interspersed groups of color sensitive areas, each group including areas that are each sensitive to different colors; and wherein after selectively exposing said photoconductive layer, a color copy is reproduced by the additional steps comprised of:

(1) flooding said photoconductive layer with one of the colors to which said photoconductive layer is sensitive;

(2) powdering the surface of the copy medium with a colored toner powder corresponding to the color of flooding light to form a portion of the color image thereon;

(3) transferring said portion of said colored image to a copy surface; and (4) repeating steps 1–3 for each color to which said photoconductive layer is sensitive.

6. The process recited in claim 1 wherein said photoconductive layer of said copy medium is comprised of a plurality of individual light transmissive photoconductive layers with each of said individual photoconductive layers being sensitive to a single but different color, and wherein after selectively exposing said photoconductive layer, a color copy is reproduced by the additional steps comprised of:

(1) flooding said photoconductive layers with a color to which one of said photoconductive layers is sensitive;
(2) powdering the surface of the copy medium with a colored toner powder corresponding to the color of flooding light to perform a portion of the color image thereon;
(3) transferring said portion of said color image to a copy surface; and
(4) repeating steps 1–3 for each color to which said photoconductive layers are sensitive.

7. A process for producing a latent electrostatic charge pattern on the surface of a layer of poled piezoelectric material forming a portion of a copy medium that also includes an electrically conductive layer and a photoconductive layer that is interposed between said piezoelectric layer and said electrically conductive layer, one of which piezoelectric and electrically conductive layers is radiation transmissive, which process comprises the steps of:
(1) forming an electrostatic charge of one polarity on an upper surface of said piezoelectric layer and an electrostatic charge of opposite polarity on a lower surface of said piezoelectric layer by mechanically stressing said piezoelectric layer;
(2) transferring a portion of the charge on the upper surface of said piezoelectric layer to said electrically conductive layer; and
(3) selectively exposing said photoconductive layer to radiation to develop an electrostatic charge pattern representative of the selective exposure on the surface of the piezoelectric layer.

8. The process recited in claim 7 wherein said steps are performed in the following order:
(1) forming an electrostatic charge of one polarity on the upper surface of said piezoelectric layer and an electrostatic charge of opposite polarity on the lower surface of said piezoelectric layer by stressing said piezoelectric layer;
(2) transferring a portion of the charge on the upper surface of said piezoelectric layer to said electrically conductive layer while said photoconductive layer is not exposed to radiation; and
(3) selectively exposing said photoconductive layer to radiation.

9. The process recited in claim 8 further including the step of uniformly adding charges of one polarity to the upper surface of said piezoelectric layer and charges of opposite polarity to the lower surface thereof intermediate said charge transfer and said selective exposure.

10. The process recited in claim 7 wherein said steps are performed in the following order:
(1) forming an electrostatic charge of one polarity on the upper surface of said piezoelectric layer and an electrostatic charge of opposite polarity on the lower surface of said piezoelectric layer by stressing said piezoelectric layer;
(2) transferring a portion of the charge on the upper surface of said piezoelectric layer to the electrically conductive layer and selectively exposing said photoconductive layer to radiation substantially simultaneously; and
(3) flooding said copy medium with radiation.

11. The process recited in claim 7 wherein the magnitude of said latent electrostatic charge pattern is changed by uniformly adding charges of one polarity to the upper surface of said piezoelectric layer and charges of opposite polarity to the lower surface of said piezoelectric layer.

12. The process recited in claim 11 wherein the latent electrostatic charge pattern on the surface of said poled piezoelectric layer is uniformly changed by varying the stress on said piezoelectric layer.

13. The process recited in claim 7 wherein the polarity of said latent electrostatic charge pattern is reversed after said photoconductive layer is selectively exposed to radiation.

14. The process recited in claim 13 wherein the polarity of said latent electrostatic charge pattern is reversed by uniformly adding charges of one polarity to the upper surface of said piezoelectric layer and charges of opposite polarity to the lower surface of said piezoelectric layer.

15. The process recited in claim 14 wherein the charges on the surfaces of said poled piezoelectric layer are uniformly changed by varying the stress on said poled piezoelectric layer.

16. The process recited in claim 7 wherein the transfer of a portion of the charge on the upper surface of said piezoelectric layer to said electrically conductive layer is preformed prior to the selective exposure of said photoconductive layer to radiation, and said latent electrostatic charge pattern is reversed by the steps of:
(1) transferring a portion of the charge on the upper surface of said piezoelectric layer to said electrically conductive layer while said photoconductive layer is not exposed to radiation; and
(2) flooding said photoconductive layer with radiation.

17. The process recited in claim 7 wherein said photoconductive layer of said copy medium is comprised of interspersed groups of color sensitive areas, each group including areas that are each sensitive to different colors; and wherein after selectively exposing said photoconductive layer, a color copy is reproduced by the additional steps comprised of:
(1) flooding said photoconductive layer with one of the colors to which said photoconductive layer is sensitive;
(2) powdering said piezoelectric layer with a colored toner powder corresponding to the color of flooding light to form a portion of the color image on said piezoelectric layer;
(3) transferring said portion of said colored image to a copy surface; and
(4) repeating steps 1–3 for each color to which said photoconductive layer is sensitive.

18. The process recited in claim 7 wherein said photoconductive layer of said copy medium is comprised of a plurality of individual light transmissive photoconductive layers with each of said individual photoconductive layers being sensitive to a single but different color, and wherein after selectively exposing said photoconductive layer, a color copy is reproduced by the additional steps comprised of:
(1) flooding said photoconductive layers with a color to which one of said photoconductive layers is sensitive;
(2) powdering said piezoelectric layer with a colored toner powder corresponding to the color of flooding light to form a portion of the color image on said piezoelectric layer;
(3) transferring said portion of said color image to a copy surface; and (4) repeating steps 1–3 for each color to which said photoconductive layers are sensitive.

19. A process for producing a latent electrostatic charge pattern on the surface of a layer of photoconductive material forming a portion of a copy medium that also includes an electrically conductive layer and a poled piezoelectric layer that is interposed between said photoconductive layer and said conductive layer, which process comprises the steps of:

(1) forming an electrostatic charge of one polarity on the upper surface of said poled piezoelectric layer and an electrostatic charge of opposite polarity on the lower surface of said poled piezoelectric layer by mechanically stressing said piezoelectric layer;

(2) transferring a portion of the charge on the lower surface of said poled piezoelectric layer to the upper surface of said photoconductive layer; and (3) selectively exposing said photoconductive layer to radiation to develop an electrostatic charge pattern representative of the selective exposure on the surface of the photoconductive layer.

20. The process recited in claim 19 wherein said photoconductive layer of said copy medium is comprised of interspersed groups of color sensitive areas, each group including areas that are each sensitive to different colors; and wherein after selectively exposing said photoconductive layer, a color copy is reproduced by the additional steps comprised of:

(1) flooding said photoconductive layer with one of the colors to which said photoconductive layer is sensitive;

(2) powdering said photoconductive layer with a colored toner powder corresponding to said color of flooding light to form a portion of the color image on said photoconductive layer;

(3) transferring said portion of said colored image to a copy surface; and (4) repeating steps 1–3 for each color to which said photoconductive layers are sensitive.

21. The process recited in claim 19 wherein said photoconductive layer of said copy medium is comprised of a plurality of individual photoconductive layers with each of said individual photoconductive layers being sensitive to a single but different color, and wherein after selectively exposing said photoconductive layer, a color copy is reproduced by the additional steps comprised of:

(1) flooding each of said photoconductive layers with a color to which one of said photoconductive layers is sensitive;

(2) powdering one of said photoconductive layers with a colored toner powder corresponding to said color of flooding light to form a portion of the color image on said photoconductive layer;

(3) transferring said portion of said color image to a copy surface; and (4) repeating steps 1–3 for each color to which said photoconductive layers are sensitive.

22. A process for producing a latent electrostatic charge pattern on the surface of a first poled piezoelectric layer forming a portion of a copy medium that also includes a photoconductive layer in surface-to-surface contact with and electrically connected to said first piezoelectric layer, a second poled piezoelectric layer in surface-to-surface contact with and electrically connected to said photoconductive layer, and an electrically conductive layer in surface-to-surface contact with an electrically connected to said second piezoelectric layer, which process comprises the steps of:

(1) forming an electrostatic charge of one polarity on the upper surfaces of said piezoelectric layers and an electrostatic charge of opposite polarity on the lower surfaces of said piezoelectric layers by mechanically stressing said piezoelectric layers;

(2) transferring a portion of the charge on the upper surface of said first piezoelectric layer to the electrically conductive layer; and (3) selectively exposing said photoconductive layer to radiation to develop an electrostatic charge pattern representative of the selective exposure on the surface of the first poled piezoelectric layer.

23. The process recited in claim 22 wherein said photoconductive layer of said copy medium is comprised of interspersed groups of color sensitive areas, each group including areas that are each sensitive to different colors; and wherein after selectively exposing said photoconductive steps layer, a color copy is reproduced by the additional steps comprised of:

(1) flooding said photoconductive layer with one of the colors to which said photoconductive layers is sensitive;

(2) powdering said first piezoelectric layer with a colored toner powder corresponding to the color of flooding light to form a portion of the color image on said first piezoelectric layer;

(3) transferring said portion of said colored image to a copy surface; and (4) repeating steps 1–3 for each color to which said photoconductive layer is sensitive.

24. The process recited in claim 22 wherein said photoconductive layer of said copy medium is comprised of a plurality of individual photoconductive layers with each of said individual photoconductive layers being sensitive to a single but different color, and wherein after selectively exposing said photoconductive layer, a color copy is reproduced by the additional steps comprised of:

(1) flooding one of said photoconductive layers with the color to which said photoconductive layer is sensitive;

(2) powdering said first piezoelectric layer with a colored toner powder corresponding to the color of flooding light to form a portion of the color image on said first piezoelectric layer;

(3) transferring said portion of said color image to a copy surface; and (4) repeating steps 1–3 for each color to which said photoconductive layers are sensitive.

25. A photoconductive piezoelectric copy medium for providing a latent electrostatic charge pattern on an electrically nonconductive exposed surface thereof, comprising:

(1) a first poled electrically nonconductive piezoelectric layer that provides an electrostatic charge of one polarity on its upper surface and an electrostatic charge of opposite polarity on its lower surface when mechanically stressed;

(2) a photoconductive layer that has its upper surface juxtaposed with and electrically connected to the lower surface of said first piezoelectric layer such that a portion of the charge on the upper surface of said piezoelectric layer can be transferred to the lower surface of said photoconductive layer so that a voltage potential is developed across the photoconductive layer; and (3) not more than one of said piezoelectric and photoconductive layers has a conductive layer juxtaposed with and electrically connected thereto such that when the photoconductive layer is selectively exposed, an electrostatic charge pattern representative of the selective exposure develops on the electrically nonconductive exposed surface of the copy medium.

26. The copy medium recited in claim 25 wherein said photoconductive layer contains interspersed groups of color sensitive areas, each group including areas that are each sensitive to different colors.

27. The copy medium recited in claim 25 wherein said photoconductive layer is comprised of a plurality of photoconductive layers each of which is sensitive to a different color.

28. The copy medium recited in claim 25 wherein at least one electrically insulative layer is juxtaposed with at least one of said piezoelectric and photoconductive layers.

29. The copy medium recited in claim 25 wherein an electrically conductive layer is juxtaposed with and electrically connected to only said photoconductive layer such that said photoconductive layer is interposed between said piezoelectric and conductive layers, and at least one of said piezoelectric and said electrically conductive layers is radiation transmissive to permit exposure to radiation of said photoconductive layer.

30. The copy medium recited in claim 29 wherein said photoconductive layer contains interspersed groups of color sensitive areas, each group including areas that are each sensitive to different colors.

31. The copy medium recited in claim 29 wherein said photoconductive layer is comprised of a plurality of photoconductive layers each of which is sensitive to a different color.

32. The copy medium recited in claim 29 wherein said electrically conductive layer is less compliant than said piezoelectric layer.

33. The copy medium recited in claim 32 wherein said photoconductive layer contains interspersed groups of color sensitive areas, each group including areas that are sensitive to different colors.

34. The copy medium recited in claim 32 wherein said photoconductive layer is comprised of a plurality of photoconductive layers each of which is sensitive to a different color.

35. The copy medium recited in claim 29 wherein at least one electrically insulative layer is juxtaposed with at least one of said piezoelectric and photoconductive layers.

36. The copy medium recited in claim 29 wherein a second piezoelectric layer is juxtaposed with, electrically connected to, and interposed between said photoconductive and electrically conductive layers.

37. The copy medium recited in claim 36 wherein said photoconductive layer contains interspersed groups of color sensitive areas, each group including areas that are each sensitive to different colors.

38. The copy medium recited in claim 36 wherein said photoconductive layer is comprised of a plurality of photoconductive layers each of which is sensitive to a different color.

39. The copy medium recited in claim 36 wherein said electrically conductive layer is less compliant than said piezoelectric layers.

40. The copy medium recited in claim 39 wherein said photoconductive layer contains interspersed groups of color sensitive areas, each group including areas that are each sensitive to different colors.

41. The copy medium recited in claim 39 wherein said photoconductive layer is comprised of a plurality of photoconductive layers each of which is sensitive to a different color.

42. The copy medium recited in claim 36 wherein at least one electrically insulative support layer is juxtaposed with at least one of said piezoelectric and photoconductive layers, and said insulative support layer is less compliant than said piezoelectric layers.

43. The copy medium recited in claim 25 wherein an electrically conductive layer is juxtaposed with and electrically connected to only said piezoelectric layer such that said piezoelectric layer is interposed between said photoconductive and conductive layers.

44. The copy medium recited in claim 43 wherein said photoconductive layer contains interspersed groups of color sensitive areas, each group including areas that are each sensitive to different colors.

45. The copy medium recited in claim 43 wherein said photoconductive layer is comprised of a plurality of photoconductive layers each of which is sensitive to a different color.

46. The copy medium recited in claim 43 wherein said electrically conductive layer is less compliant than said piezoelectric layer.

47. The copy medium recited in claim 46 wherein said photoconductive layer contains interspersed groups of color sensitive areas, each group including areas that are each sensitive to different colors.

48. The copy medium recited in claim 46 wherein said photoconductive layer is comprised of a plurality of photoconductive layers each of which is sensitive to a different color.

49. The copy medium recited in claim 43 wherein at least one electrically insulative support layer is juxtaposed with at least one of said piezolelectric and photoconductive layers and said insulative support layer is less compliant than said piezoelectric layer.

* * * * *